United States Patent [19]

Boatman

[11] 3,988,845

[45] Nov. 2, 1976

[54] SIGN DEVICE HAVING MAGNETIC DISPLAY CHARACTERS

[75] Inventor: Billy J. Boatman, Sedalia, Mo.

[73] Assignee: Sedalia Neon Company, Sedalia, Mo.

[22] Filed: Aug. 7, 1975

[21] Appl. No.: 602,790

[52] U.S. Cl. ..... 40/142 A; 40/125 E; 40/130 J

[51] Int. Cl.[2] ..... G09F 7/04

[58] Field of Search ..... 40/142 A, 125 E, 125 A, 40/130 J, 28 C, 125 F; 35/7 A

[56] References Cited

UNITED STATES PATENTS

| | | | |
|---|---|---|---|
| 1,609,989 | 12/1926 | Chubb | 40/28 C |
| 2,346,582 | 4/1944 | Insler et al. | 40/142 A X |
| 2,965,978 | 12/1960 | Olson | 40/142 A X |
| 3,080,664 | 3/1963 | Bland | 35/7 A X |
| 3,093,919 | 6/1963 | Holtz | 40/125 F X |
| 3,156,056 | 11/1964 | Pribil | 40/142 A X |
| 3,226,838 | 1/1966 | Courrege et al. | 40/142 A X |
| 3,651,592 | 3/1972 | McCormick et al. | 40/142 A |

OTHER PUBLICATIONS

Rubber Magnet Brochure, Charles Mayer Studios Inc., 1960, 2 pages, 40–142A.

*Primary Examiner*—John F. Pitrelli
*Attorney, Agent, or Firm*—Lowe, Kokjer, Kircher, Wharton & Bowman

[57] ABSTRACT

A sign for displaying messages includes a pair of dark backing boards supported within a frame. Thin flexible discs magnetically adhere to the boards to form words, letters, and other selected patterns thereon. The outer surfaces of the discs reflect light and/or are different in color than the backing boards in order to illustrate the displayed message.

8 Claims, 3 Drawing Figures

SIGN DEVICE HAVING MAGNETIC DISPLAY CHARACTERS

BACKGROUND AND SUMMARY OF THE INVENTION

This invention relates generally to sign devices and deals more particularly with a sign in which display characters are retained on a backing board by magnetic attraction.

Primarily because of the inflexibility and the high construction/operating costs of neon signs and other electronic display devices, efforts have been made to develop more economical and easily changeable signs for both outdoor and indoor advertising. Known prior art signs that mount display characters on a backing typically require complicated mechanical mounting devices such as clamps and the like in order to adequately retain the display characters in place. This involves considerable expense and also makes it a difficult and time consuming task to change messages. Additional costs are involved in constructing the letters and numbers that are used as the display characters in most of these devices. Moreover, external power sources are usually required, and this further increases the cost.

It is an important object of the present invention to provide an improved sign device with message flexibility that is more economical to construct and operate than prior art signs.

More specifically, an object of the invention is to provide a sign in which magnetized display characters are firmly held in place in selected patterns on a backing board. In connection with this object, it is a significant feature of the invention that the discs which comprise the display characters present large surface areas for contact with the backing board and are extremely thin so that they are unlikely to be inadvertently displaced on the board.

An additional object of the invention is to provide, in a sign of the character described, display characters that are flexible in order to increase their durability and facilitate their removal from the backing board.

A further object of the invention is to provide a sign of the character described wherein the backing board includes a grid which permits quick arrangement of the display characters in the proper spacial relationship for each particular message displayed.

A still further object of the invention is to provide a sign of the character described in which the backing board is recessed within a supporting frame so as to locate the display characters in a protected position.

Yet another object of the invention is to provide a sign of the character described which is adapted to display messages on both of its sides and which requires no external power source.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
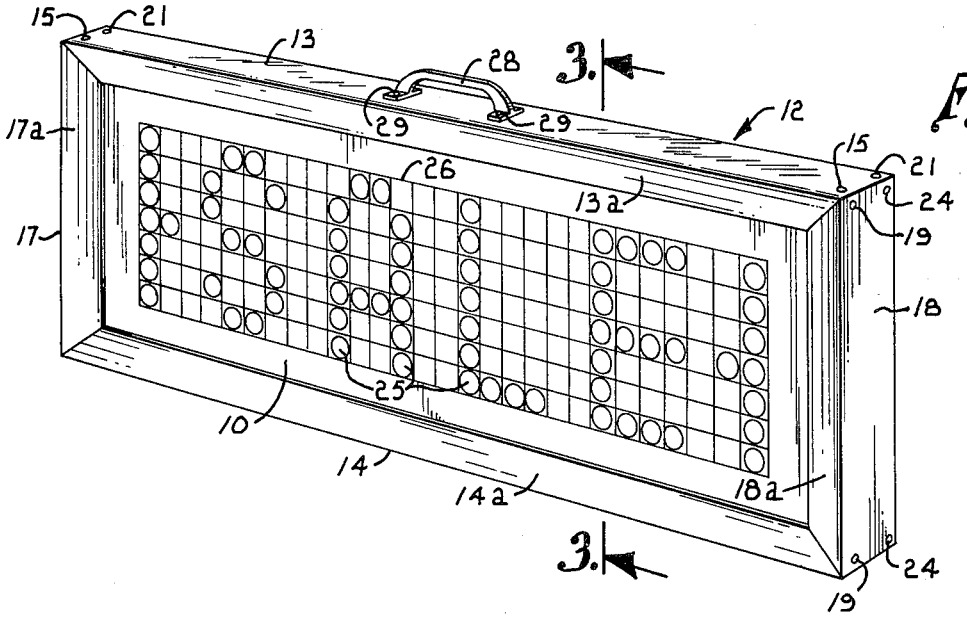
FIG. 1 is a perspective view of a sign constructed in accordance with the invention.

Referring now to the drawing in more detail, and initially to FIG. 1, a sign constructed according to the invention includes a flat rectangular backing board 10 which presents a dark background surface on one side of the sign. Board 10 is preferably constructed of steel in order to attract a magnet. Alternatively, board 10 may be constructed of a substance such as a rigid plastic which is coated or permeated with powdered iron or a similar ferro-magnetic material and could be translucent to accommodate a light source therebehind.

Figure 3:
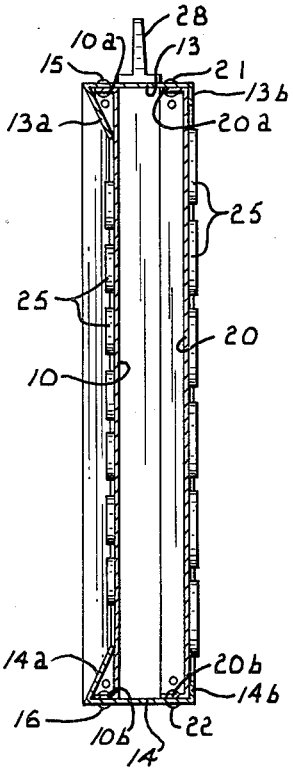
FIG. 3 is a cross sectional view on an enlarged scale taken generally along line 3—3 of FIG. 1 in the direction of the arrows.

Board 10 is mounted within a rectangular frame structure which is generally designated by reference numeral 12. With particular reference to FIG. 3, the frame includes parallel top and bottom frame members 13 and 14. The top frame member 13 has a forward flange **13*a* which is bent downwardly and somewhat rearwardly from the front edge thereof. Preferably flange 13*a* forms an angle of approximately 60° relative to the top panel of member 13. The lower frame member 14 is provided with a forward flange 14*a* which is bent upwardly and rearwardly, again preferably at an angle of approximately 60°. Board 10 has a top flange 10*a* and a bottom flange 10*b* which are turned forwardly from the top and bottom edges of the board at right angles. Flange 10*a* is connected to member 13 near its opposite ends by rivets 15, while flange 10*b* is similarly connected to member 14 by rivets 16**.

Frame 12 further includes opposite side members 17 and 18 which are parallel to one another and which extend between the ends of members 13 and 14. With reference to FIG. 1, members 17 and 18 have respective forward flanges **17*a* and 18*a* which are bent inwardly and rearwardly at angles of approximately 60°. Board 10 has side flanges (not shown) which are turned forwardly from the side edges of the board and which are connected to the respective side frame members 17 and 18 by rivets 19. Board 10 is thus mounted within the rectangular frame 12, and it is noted that the board is recessed rearwardly of the forward edge of the frame at a location adjacently behind the edges of the angled flanges 13*a*, 14*a*, 17*a* and 18*a*. As best illustrated in FIG. 1**, the flanges are each beveled at their opposite ends so that adjacent flanges meet edge to edge.

Another flat rectangular backing board 20 is mounted within frame 12 on the side of the sign opposite from board 10. Like board 10, board 20 presents a dark background and is constructed or otherwise provided with a substance that will strongly attract a magnet. Referring to FIG. 3, flanges **20*a* and 20*b* are turned forwardly at right angles from the respective upper and lower edges of board 20, and side flanges (not shown) are similarly turned forwardly at right angles from the side edges of the board. Rivets 21 and 22 connect flanges 20*a* and 20*b* to the respective top and bottom frame members 13 and 14, while rivets 23 and 24 connect the side flanges (not shown) of board 20 to the respective side frame members 17 and 18. Accordingly, board 20 is mounted within frame 12 at a location parallel to and spaced from board 10. Frame members 13, 14, 17 and 18 have short flanges 13*b*, 14*b*, 17*b* and 18*b*, respectively, which are turned at right angles from the rearward edges of the frame members and which lie flatly against board 20** near the four edges thereof. These flanges are each beveled at their opposite ends so that adjacent flanges meet edge to edge.

A plurality of circular discs 25 serve as display characters which magnetically adhere to boards 10 and 20 to form displays thereon. It is desirable for discs 25 to have relatively large surface areas for firm attachment to the boards. Additionally, it is also desirable for the discs to be as thin as practical so that they will not be easily displaceable on the boards. Accordingly, each disc 25 is a flat member having a uniform thickness of approximately 0.02 inch and a diameter preferably over ½inch. The discs are flexible to enhance their durability and to facilitate their handling during removal from the boards, as will be explained in more detail. The discs are preferably constructed of a flexible plastic substance or a similar flexible material having suitable resiliency.

As previously suggested, discs 25 act as permanent magnets that are strongly attracted to boards 10 and 20. Magnetic iron powder or any other appropriate magnetic substance is coated on or imbedded in one surface of each disc. Alternatively, the magnetic substance may be distributed throughout the entirety of each disc. The surface of each disc opposite the magnetic coating is painted with either a light reflective or luminescent material so that each disc will either be illuminated by the surrounding light or will emit light itself. The discs thus present outwardly facing surfaces that contrast sharply with the dark backing boards 10 and 20 to which they are attached. Likewise, if a light source were to be used behind the backing boards, the contrasting opaqueness of the discs presents an easily readable sign.

Boards 10 and 20 are provided with respective grids 26 and 27 that extend throughout a major portion of the board surfaces but not the entirety thereof. Each grid 26 and 27 comprises intersecting lines which form a plurality of square areas sized to receive discs 25. It is contemplated, but not necessary to the invention, that the discs 25 which are used on board 20 will be greater in diameter than those used on board 10. Therefore, the squares presented by grid 27 are preferably larger than those of grid 26 in order to accommodate the larger discs.

A handle 28 is secured centrally to the upper frame member 13 to permit the sign to be easily carried by hand. The handle is attached to member 13 by screws 29 (FIG. 1).

In use, the strong magnetic attraction between discs 25 and boards 10 and 20 permits the discs to be arranged as desired on either or both of the boards. Discs 25 are placed on the boards in a pattern to form letters, words, numbers, or any other desired display. For example, FIG. 1 illustrates the discs arranged on board 10 to form the word "sale". Grids 26 and 27 facilitate the quick arrangement of the discs and assure that they are spaced appropriately with the letters and/or numbers properly proportioned for a pleasant appearance. The dark backgrounds of boards 10 and 20 contrast sharply with the light colored discs so that the messages are easily visible from a considerable distance, even in the daytime.

Figure 2:
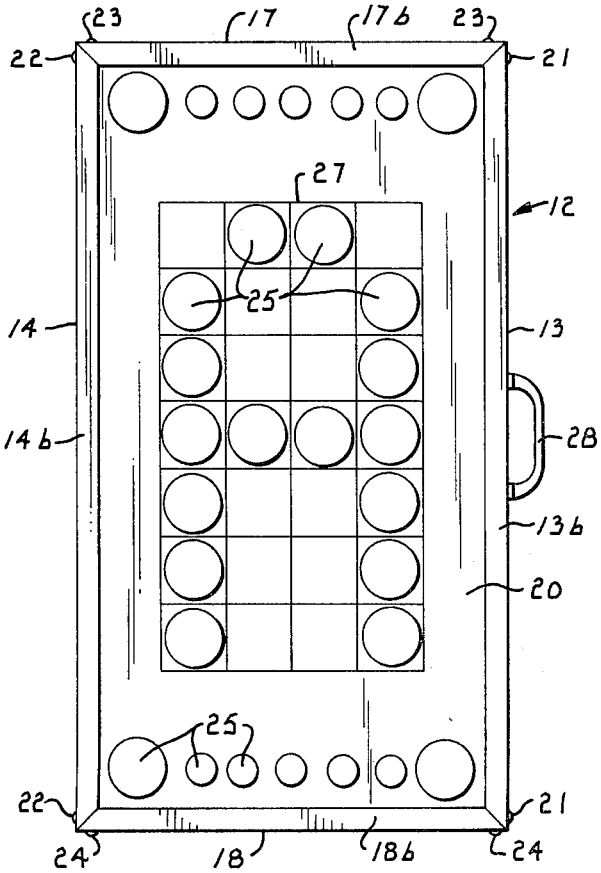
FIG. 2 is an elevational view from the rear of the sign shown in FIG. 1, with the sign rotated 90° from the FIG. 1 position.

It is pointed out that the sign can be oriented either horizontally as shown in FIG. 1 or vertically as shown in FIG. 2, wherein the large letter "A" is displayed on board 20. It is again noted that board 10 is recessed rearwardly of the forward edge of frame 12. This shields discs 25 to a substantial extent and reduces the likelihood of the discs being inadvertently displaced on the board as a result of external forces such as wind and the like. In this regard, the extremely thin construction of the discs, along with their relatively large surface areas in contact with the board, assists in reducing the possibility of displacement.

In order to change the display it is only necessary to rearrange discs 25 on the boards. The discs are easily removed from the boards despite their thin construction because the flexibility of the discs permits them to flex as one edge is grasped and pulled away from the board. Consequently, flexible discs are more desirable than display members of a more rigid construction would be.

Although it is preferred that the display characters (discs 25) be the magnetized members because it has been found more economical to construct the sign in this manner, it is apparent that backing boards 10 and 20 could be magnetized and that discs 25 could be provided with ferro-magnetic material. It is therefore to be understood that the scope of the invention is not intended to be limited to magnetized display characters and that magnetized backing boards could be provided as an alternative arrangement.

From the foregoing, it will be seen that this invention is one well adapted to attain all of the ends and objects hereinabove set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my invention, what I claim is:

1. Display apparatus comprising:

a substantially flat backing board presenting a relatively dark background;

a plurality of thin display characters, all substantially identical to one another in size, shape, and display characters, each display character being constructed of a flexible, resilient substance and each having opposite first and second surfaces, said first surface being relatively light in color to contrast with said dark background and said second surface being substantially flat for contact with said backing board;

permanent magnet means for magnetically adhering said display characters against said backing board with said second surfaces lying flatly against said board and said first surfaces facing away from said board, thereby permitting arrangement of said display characters in selected patterns on said backing board to display messages thereon according to the patterns presented, said permanent magnet means comprises a ferromagnetic substance included in said backing board for attracting a magnet and permanent magnet material included in each of said display characters, said display characters thereby magnetically adhering against said backing board;

a second substantially flat backing board presenting a relatively dark background and including a ferromagnetic substance for attracting and retaining said display characters thereon with said second surfaces lying flatly against said second board and said first surfaces facing away from said second board; and a frame supporting said backing boards a spaced distance apart to face in opposite directions, said frame extending substantially continuously around the peripheries of said backing boards.

2. Apparatus as set forth in claim 1, wherein said display characters are each constructed in the shape of a disc having a substantially circular periphery.

3. Apparatus as set forth in claim 2, wherein each of said discs has a substantially uniform thickness of approximately 0.02 inch between said first and second surfaces thereof.

4. Apparatus as set forth in claim 1, including means defining a grid on said backing board to facilitate the arrangement of said display characters thereon.

5. Apparatus as set forth in claim 1, including means for supporting said backing board at a recessed location rearwardly of the forward portion of said frame.

6. Apparatus as set forth in claim 5, wherein said frame comprises frame members interconnected in a substantially rectangular arrangement, each of said frame members having a flange angling inwardly and rearwardly from the forward portion thereof to the surface of said backing board.

7. Apparatus as set forth in claim 1, wherein the first surface of each display character is provided with a coating having light reflective characteristics.

8. Apparatus as set forth in claim 1, wherein the first surface of each display character is provided with a coating having light emissive characteristics.

* * * * *